United States Patent [19]

Burton

[11] Patent Number: 4,564,124

[45] Date of Patent: Jan. 14, 1986

[54] DISPENSING CONTAINER

[75] Inventor: George W. Burton, London, England

[73] Assignee: Johnsen & Jorgensen (Plastics) Ltd., London, England

[21] Appl. No.: 563,507

[22] Filed: Dec. 20, 1983

[30] Foreign Application Priority Data

Dec. 21, 1982 [GB] United Kingdom ..... 8236304

[51] Int. Cl.[4] ..... B65H 3/00

[52] U.S. Cl. ..... 221/263

[58] Field of Search ..... 221/263, 264, 256, 65, 221/186, 190, 266, 268, 269; 206/540; 222/362, 363, 366

[56] References Cited

U.S. PATENT DOCUMENTS 825,987 7/1906 Thompson ..... 221/190 X 3,173,579 3/1965 Curie et al. ..... 222/523

FOREIGN PATENT DOCUMENTS 2828062 10/1980 Fed. Rep. of Germany ..... 221/263

2013636 8/1979 United Kingdom ..... 221/263

*Primary Examiner*—Joseph J. Rolla

*Assistant Examiner*—David H. Bollinger

*Attorney, Agent, or Firm*—Wood, Dalton, Phillips, Mason & Rowe

[57] ABSTRACT

A dispensing container for dispensing small tablets one at a time wherein the container comprises an inner element within an outer element, both elements being substantially rectangular in plan so as to form a flat dispensing pack, and wherein the outer element has a tablet orienting member with a channel to receive tablets and to arrange the tablets in alignment, the channel terminating at one end thereof adjacent to a pocket provided in a projecting member, on the inner element, which is shaped to receive a single tablet, a dispensing opening being provided in the bottom of the outer element through which the projecting member can pass in such a way as normally to close the opening, downward movement of the inner member relatively to the outer member being effective to uncover the opening to dispense a single tablet.

7 Claims, 4 Drawing Figures

DISPENSING CONTAINER

This invention is concerned with the provision of a container adapted to dispense articles such as tablets, pills, sweets and so forth one at a time. Dispensing containers of this kind are very useful for dispensing sweetener tablets but for that purpose it is desirable that they should be small, that they are easy and reliable to use and inexpensive so that they can, if necessary, be given away.

In the light of the above we believe that a dispensing container of this kind should be designed so that it can be moulded in the minimum number of (say) two parts, so that it can be easily filled and assembled and so that it has a minimum of movable parts.

According to the present invention there is provided a dispensing container comprising an inner element and an outer element with a filling opening and a bottom wall, the outer element substantially enclosing the inner element when the two parts of the container are assembled, an article orienting member at the bottom of the outer element with a channel to receive articles arranged in alignment already to be dispensed one at a time, a projecting attachment on the inner element with a pocket therein to receive a single article, an opening in the bottom of the outer element so dimensioned that the projecting attachment can pass through the opening but is normally positioned so as to close the opening and spring means at the lower end of the inner element, the arrangement being such that when the inner member is pressed it is moved axially downwards relative to the outer element so that the projecting attachment is moved through the opening in the bottom of the inner element to dispense a single article from the pocket and at the same time to close the end of the channel to prevent a second article being dispensed.

Figure 1:
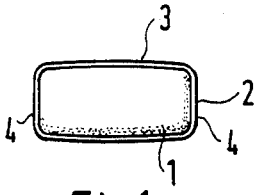
Figure 2:
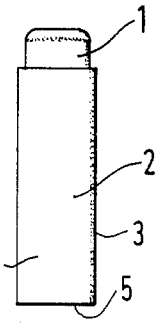
Figure 3:
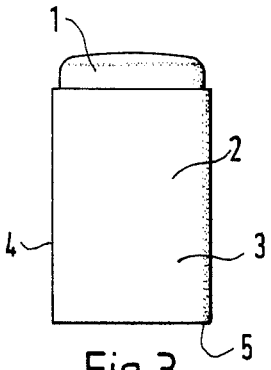
Figure 4:
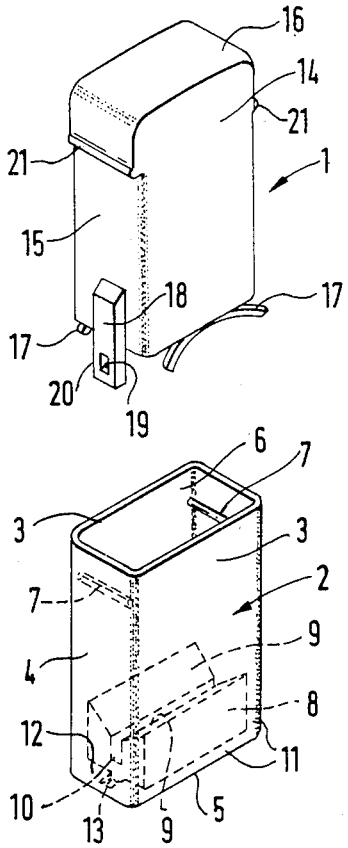

In order that the invention may be more clearly understood reference is now directed to the accompanying drawings given by way of example in which:

FIGS. 1,2 and 3 are respectively a plan view, an end view and a side view of an assembled dispensing container according to the invention, and FIG. 4 is a pictorial view showing the two parts of the dispensing container separately.

Referring to the drawings the dispensing container has two parts an inner element 1 and an outer element 2 which substantially encloses the inner element 1 except for a top section thereof which normally projects above the outer element.

The outer element 2 has side walls 3, end walls 4, a bottom wall 5 and an opening 6 at the top. The outer element also has internal retaining beads or ridges 7 on each end wall 4 and an orienting member 8 at the bottom. The orienting member 8 is in the form of a block with inclined top walls or surfaces 9 sloping inwards to a channel 10 extending substantially from end to end of the block spaces 11 being left at each side and at one end of the block and a larger space 12 at the other end of the block. An opening 13 is provided in the bottom wall 5 in the space 12, the opening 13 being in alignment with the end of the channel 10 in the orienting member 8 which slopes downwards towards opening 13.

The inner element 1 has sidewalls 14, end walls 15, a top 16 and is open at the bottom. Two bowed leaf springs 17 are provided at the bottom of sidewalls 14 and at one end the element 1 has a projecting attachment 18 with a pocket 19 in the part 20 that extends below the bottom of the element 1. External projecting beads or ridges 21 are provided at each end wall 15 for co-operation with the beads or ridges 7.

The two elements are preferably moulded from a suitable plastics material such as polypropylene but may if desired be made in any other suitable way and of any other suitable material. The end walls at least should be suitably resilient to allow the beads or ridges 21 to pass the beads or ridges 7 when the elements are being assembled and (if desired) disassembled. The precise shape and size of the container does not matter but we have found that the small flat pack shown is practical and convenient for pocket or purse. The channel 10 is shaped to receive the articles to be dispensed which in this case will be flat disc-shaped sweeteners. If spherical pills are to be dispensed the channel 10, pocket 19 and opening 13 would all be modified to suit.

In operation the inner element 1 will be turned upside down compared with the position shown in FIG. 4 and the element will be at least partially filled with articles through what has been described as the open bottom. With the element 1 still in the inverted position, the element 2 is then assembled over the element 1 and the assembled dispensing container may be returned to the position shown in FIGS. 1, 2 and 3. When in this position the beads or ridges 21 are disposed below the beads or ridges 7 to retain the elements 1 and 2 in assembled position, the springs 17 are disposed in the spaces 11, and the attachment 18 is disposed in the space 12 with the bottom of the attachment in or over the opening 13 so as to close the opening and with the pocket 19 in alignment with the end of the channel 10. Gentle shaking of the dispenser will then cause articles to align themselves along the channel 10 and one article will enter the pocket 19 by rolling downwards. In this connection care must be taken to make the pocket of the correct size and shape to ensure that the whole of one article can enter the pocket and at the same time prevent a second article from partially leaving the channel. To dispense an article the projecting part of the inner element 1 is depressed against the pressure of the springs 17. This causes axial movement of the entire element 1 relatively to the element 2 so that the attachment 18 moves down through the opening 13 in the element 2 until the pocket 19 is uncovered and the single article in the pocket is dispensed. At the same time the upper part of the attachment or the wall 15 will cover the end of the channel to prevent a second article from being dispensed.

When pressure on the top of the element 1 is released the springs move the element 1 back to its original position and another article enters the pocket 19 ready to be dispensed on the next depression of the element 1.

The new dispenser is simple and inexpensive, can be relatively flat and small and can easily be operated by one hand. We have therefore provided a two part dispensing container in which axial movement of one part relatively to the other part moves a dispensing attachment from a feed position in which a single article to be dispensed can enter a pocket in the attachment from an orienting channel 1 in the dispenser to a dispensing position in which the article in the pocket is dispensed and the connection between the channel and the pocket is closed.

The pocket 19 may have a bottom that slopes downwardly from the inside towards the outside i.e. away from the dispenser to assist an article to leave the pocket as soon as the element 1 is depressed.

I claim:

1. A dispensing container comprising an inner element and an outer element with a filling opening and a bottom wall, the outer element substantially enclosing the inner element when the two parts of the container are assembled, an article orienting member at the bottom of the outer element in the form of a block with spaced ends and inclined top surfaces sloping inwards to a channel extending substantially from end to end of the block to receive articles arranged in alignment ready to be dispensed one at a time, there being relatively small spaces provided at each side and at one end of the block and a larger space at the other end of the block, a projecting attachment on the inner element with a pocket therein to receive a single article, a dispensing opening in the bottom wall of the outer element in the large space and in alignment with the end of the channel, which slopes downwards towards the dispensing opening, said outer element so dimensioned that the projecting attachment can pass through the opening but is normally positioned so as to close the opening and spring means at the lower end of the inner element, the arrangement being such that when the inner member is pressed it is moved axially downwards relative to the outer element so that the projecting attachment is moved through the dispensing opening in the bottom of the outer element to dispense a single article from the pocket and at the same time to close the end of the channel to prevent a second article being dispensed.

2. A dispensing container according to claim 1 wherein a top section of the inner element normally projects above the outer element.

3. A dispensing container according to claim 1 wherein the outer element has end walls with means internally thereof on each end wall for retaining in place the inner element.

4. A dispensing container according to claim 3 wherein the inner element has sidewalls, end walls, a top and is partially open at the bottom and wherein a plurality of bowed leaf springs are provided at the bottom of the sidewalls, one end of the inner element being provided with the projecting attachment which has a pocket in a part that extends below the bottom of the inner element, external retaining means being provided on each end wall of the inner element for cooperation with the internal retaining means on the outer element.

5. A dispensing container according to claim 1 wherein the overall configuration of the dispensing container takes the form of a small flat pack.

6. A dispensing container according to claim 1 wherein the channel orienting is specially shaped to receive the articles to be dispensed.

7. A dispensing container for dispensing small tablets one at a time wherein the container comprises an inner element within an outer element, both elements being substantially rectangular in plan so as to form a flat dispensing pack, and wherein the outer element has a tablet orienting member in the form of a block with spaced ends and a channel to receive tablets and to arrange the tablets in alignment, there being relatively small spaces at each side and at one end of the block and a larger space at the other end of the block, the channel terminating at one end thereof adjacent to a pocket provided in a projecting member on the inner element, which pocket is shaped to receive a single tablet, a dispensing opening being provided in the bottom of the outer element in the larger space through which the projecting member can pass in such a way as normally to close the opening, said dispensing opening being in alignment with an end of the channel, which slopes downward towards the dispensing opening, downward movement of the inner member relatively to the outer member being effective to uncover the opening to dispense a single tablet.

* * * * *